US011011849B2

(12) United States Patent
Hsiao et al.

(10) Patent No.: US 11,011,849 B2
(45) Date of Patent: May 18, 2021

(54) ANTENNA STRUCTURE

(71) Applicant: Wistron NeWeb Corp., Hsinchu (TW)

(72) Inventors: An-Ting Hsiao, Hsinchu (TW); Shang-Sian You, Hsinchu (TW); Cheng-Geng Jan, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 63 days.

(21) Appl. No.: 16/700,015

(22) Filed: Dec. 2, 2019

(65) Prior Publication Data

US 2020/0350690 A1 Nov. 5, 2020

(30) Foreign Application Priority Data

May 3, 2019 (TW) ..... 108115320

(51) Int. Cl.
*H01Q 13/10* (2006.01)
*H01Q 1/24* (2006.01)
*H01Q 1/38* (2006.01)

(52) U.S. Cl.
CPC ..... *H01Q 13/106* (2013.01); *H01Q 1/243* (2013.01); *H01Q 1/38* (2013.01)

(58) Field of Classification Search
CPC ..... H01Q 1/243; H01Q 1/38; H01Q 5/364; H01Q 9/0464; H01Q 9/0435; H01Q 13/106
See application file for complete search history.

(56) References Cited

U.S. PATENT DOCUMENTS 6,016,090 A * 1/2000 Iio ..... H01P 1/20318 331/107 DP
2002/0054467 A1* 5/2002 Tsai ..... H01L 23/49827 361/302
2002/0093460 A1* 7/2002 Alexeff ..... H01Q 1/081 343/901
2006/0164304 A1* 7/2006 Huang ..... H01Q 9/0414 343/700 MS
2011/0038502 A1* 2/2011 Shun Shiu ..... H04R 19/016 381/355
2013/0307746 A1* 11/2013 Nakano ..... H01Q 1/2225 343/850
2015/0295599 A1* 10/2015 Fujiwara ..... H01P 7/084 455/41.1

(Continued)

*Primary Examiner* — Graham P Smith
*Assistant Examiner* — Jae K Kim
(74) *Attorney, Agent, or Firm* — McClure, Qualey & Rodack, LLP

(57) ABSTRACT

An antenna structure includes a radiation metal element, a first feeding metal element, a second feeding metal element, a metal loop, a ground metal element, a first dielectric layer, a second dielectric layer, and a via metal element. The radiation metal element has a first slot, a second slot, a third slot, and a fourth slot, which surround a first opening, a second opening, a third opening, and a fourth opening. The first feeding metal element extends into the first opening. The second feeding metal element extends into the second opening. The first dielectric layer is disposed between the radiation metal element and the metal loop. The second dielectric layer is disposed between the metal loop and the ground metal element. The via metal element couples a first connection point on the radiation metal element to a second connection point on the ground metal element.

20 Claims, 7 Drawing Sheets

(56) References Cited

U.S. PATENT DOCUMENTS

| | | | | |
|---|---|---|---|---|
| 2016/0017999 | A1* | 1/2016 | Boyd | B64C 3/34 277/651 |
| 2017/0201011 | A1* | 7/2017 | Khripkov | H01Q 1/50 |
| 2017/0212479 | A1* | 7/2017 | Kwon | G04R 60/08 |
| 2017/0302771 | A1* | 10/2017 | Kim | H01Q 1/243 |
| 2018/0010948 | A1* | 1/2018 | Edvardsson | G01S 7/03 |
| 2018/0129170 | A1* | 5/2018 | Yun | G06F 1/163 |
| 2019/0067803 | A1* | 2/2019 | Kang | G04G 21/04 |
| 2020/0037439 | A1* | 1/2020 | Kim | H05K 1/024 |
| 2020/0328530 | A1* | 10/2020 | Park | H01Q 1/2283 |

* cited by examiner

ANTENNA STRUCTURE

CROSS REFERENCE TO RELATED APPLICATIONS

This Application claims priority of Taiwan Patent Application No. 108115320 filed on May 3, 2019, the entirety of which is incorporated by reference herein.

BACKGROUND OF THE INVENTION

Field of the Invention

The disclosure generally relates to an antenna structure, and more particularly, it relates to a multiband antenna structure.

Description of the Related Art

With the advancements being made in mobile communication technology, mobile devices such as portable computers, mobile phones, multimedia players, and other hybrid functional portable electronic devices have become more common. To satisfy consumer demand, mobile devices usually implement wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna for signal reception and transmission has insufficient bandwidth, it will degrade the communication quality of the relative mobile device. Accordingly, it has become a critical challenge for antenna designers to design a small-size, multiband antenna element.

BRIEF SUMMARY OF THE INVENTION

In an exemplary embodiment, the disclosure is directed to an antenna structure which includes a radiation metal element, a first feeding metal element, a second feeding metal element, a metal loop, a ground metal element, a first dielectric layer, a second dielectric layer, and a via metal element. The radiation metal element has a first slot, a second slot, a third slot, and a fourth slot, a first opening, a second opening, a third opening, and a fourth opening. The first opening, the second opening, the third opening, and the fourth opening are surrounded by a combination of the first slot, the second slot, the third slot, and the fourth slot. The first feeding metal element is coupled to a first feeding point and extends into the first opening. The second feeding metal element is coupled to a second feeding point and extends into the second opening. The first dielectric layer is disposed between the radiation metal element and the metal loop. The second dielectric layer is disposed between the metal loop and the ground metal element. The via metal element couples a first connection point on the radiation metal element to a second connection point on the ground metal element. The first dielectric layer and the second dielectric layer have different dielectric constants.

In some embodiments, the first connection point is positioned in the center of the radiation metal element, and the second connection point is positioned in the center of the ground metal element.

In some embodiments, the first slot, the second slot, the third slot, and the fourth slot are completely separate from each other.

In some embodiments, each of the first slot, the second slot, the third slot, and the fourth slot substantially has an arc-shape or an inverted U-shape.

In some embodiments, the first slot, the second slot, the third slot, and the fourth slot are all arranged on a specific circumference. The center of the specific circumference is positioned at the first connection point.

In some embodiments, the first slot corresponds to a first central angle, the second slot corresponds to a second central angle, the third slot corresponds to a third central angle, and the fourth slot corresponds to a fourth central angle. Each of the first central angle, the second central angle, the third central angle, and the fourth central angle is from 30 to 80 degrees.

In some embodiments, each of the first opening, the second opening, the third opening, and the fourth opening substantially has a circular shape.

In some embodiments, the first opening, the second opening, the third opening, and the fourth opening are respectively positioned at four vertexes of a specific square. The center of the specific square is positioned at the first connection point.

In some embodiments, the metal loop has a vertical projection on the radiation metal element, and the vertical projection of the metal loop is substantially aligned with the specific circumference.

In some embodiments, the operation frequency band of the antenna structure covers a first frequency interval from 1117 MHz to 1137 MHz, a second frequency interval from 1166 MHz to 1186 MHz, and/or a third frequency interval from 1565 MHz to 1585 MHz.

In some embodiments, the radiation metal element substantially has a circular shape with a diameter from 0.36 to 0.69 wavelength of the operation frequency band.

In some embodiments, the radial width of each of the first slot, the second slot, the third slot, and the fourth is from 0.003 to 0.02 wavelength of the operation frequency band.

In some embodiments, the metal loop substantially has a circular shape with a diameter from 0.294 to 0.525 wavelength of the operation frequency band.

In some embodiments, the width of the metal loop is from 0.008 to 0.015 wavelength of the operation frequency band.

In some embodiments, the via metal element substantially has a cylindrical shape with a diameter from 0.002 to 0.058 wavelength of the operation frequency band.

In some embodiments, the first dielectric layer has a first dielectric constant, and the second dielectric layer has a second dielectric constant. The ratio of the first dielectric constant to the second dielectric constant is from 3 to 10.

In some embodiments, the first dielectric layer has a first thickness, and the second dielectric layer has a second thickness. The ratio of the first thickness to the second thickness is from 3 to 13.

In some embodiments, the first feeding metal element includes a first feeding disc and a first connection element. The first feeding disc is disposed in the first opening of the radiation metal element. A first coupling gap is formed between the first feeding disc and the radiation metal element. The first feeding disc is coupled through the first connection element to the first feeding point.

In some embodiments, the second feeding metal element includes a second feeding disc and a second connection element. The second feeding disc is disposed in the second opening of the radiation metal element. A second coupling gap is formed between the second feeding disc and the radiation metal element. The second feeding disc is coupled through the second connection element to the second feeding point.

In some embodiments, the antenna structure includes a circuit layer, a third dielectric layer, and a reference ground metal element. The third dielectric layer is disposed between the ground metal element and the circuit layer. The via metal element further couples the second connection point on the ground metal element to a third connection point on the reference ground metal element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
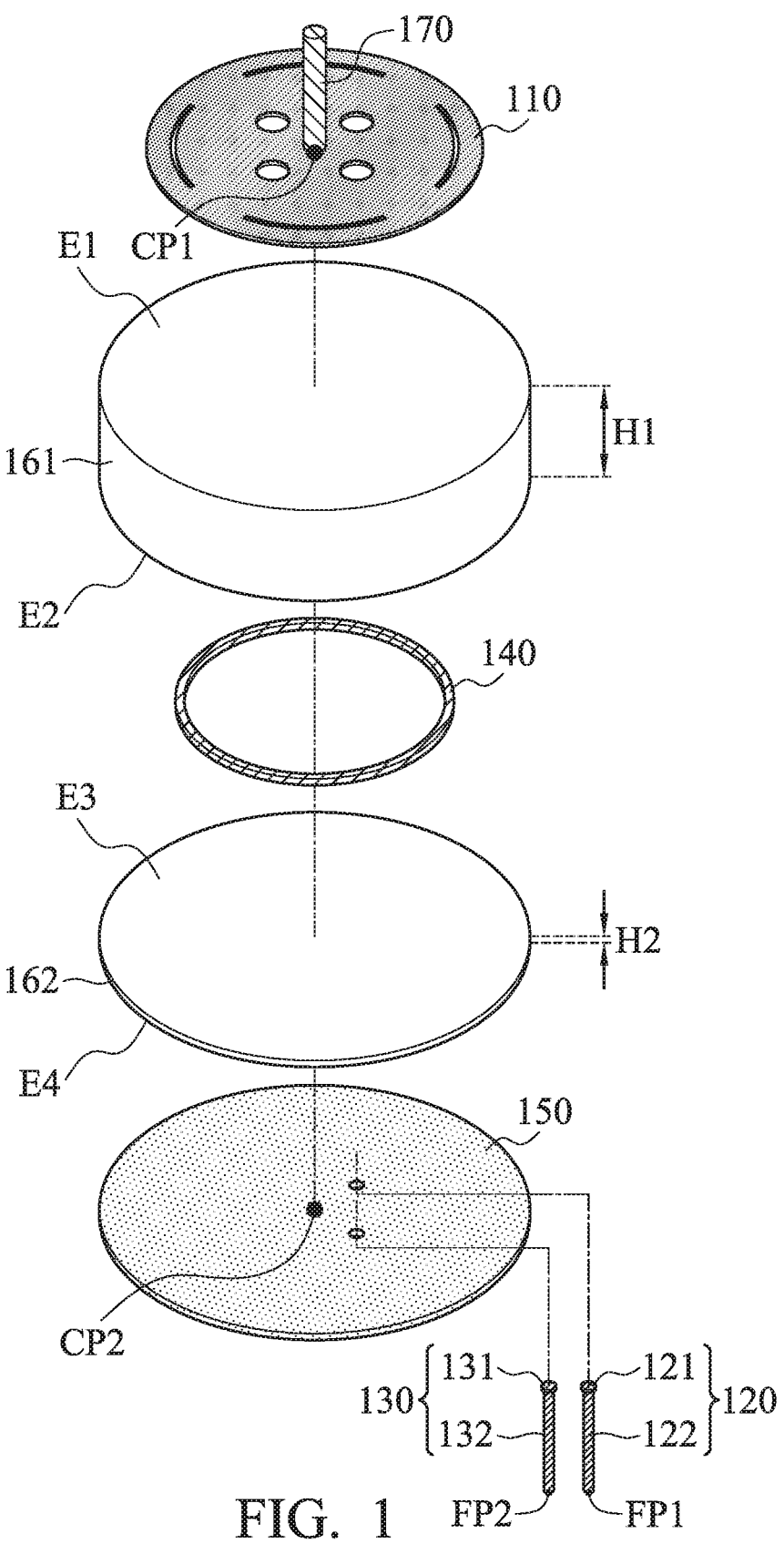
FIG. 1 is an exploded view of an antenna structure according to an embodiment of the invention.
Figure 2:
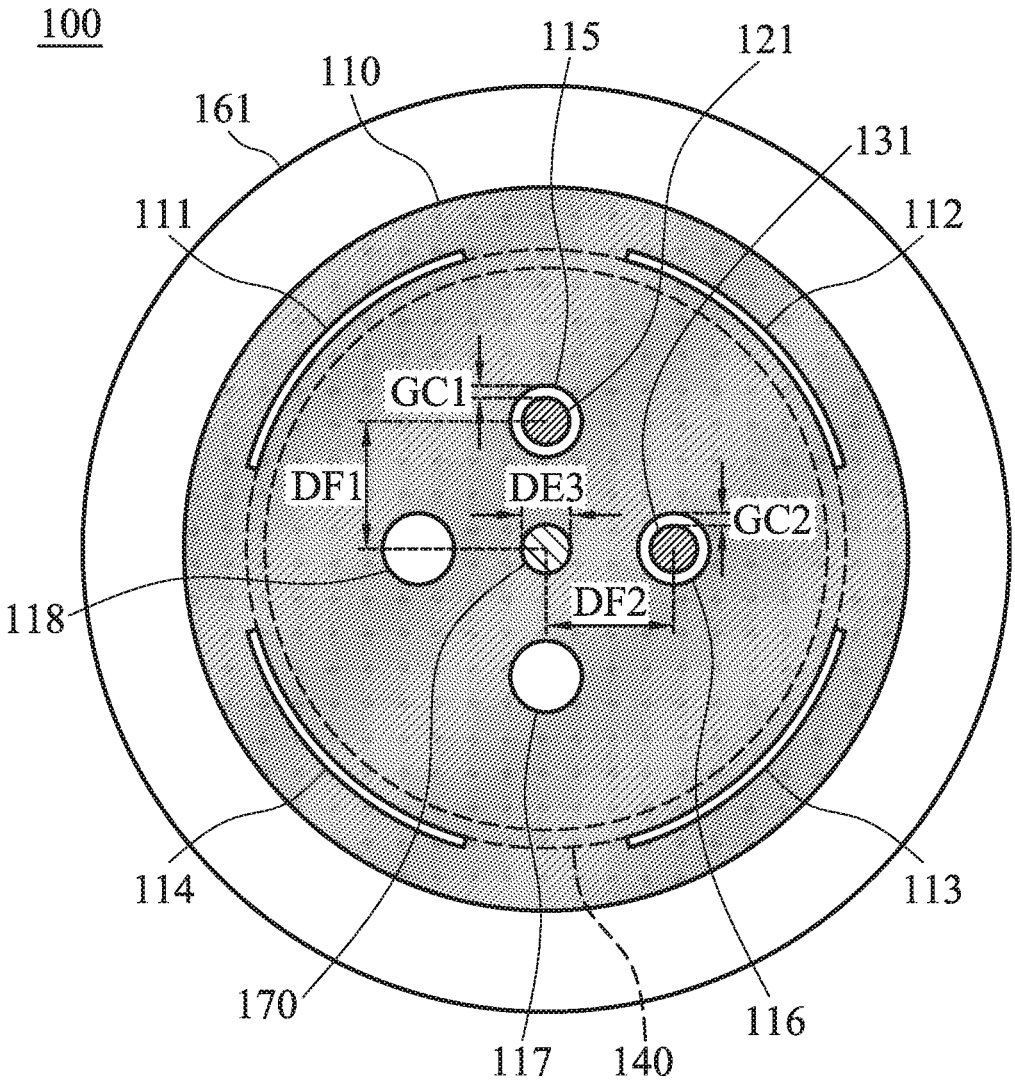
FIG. 2 is a top view of an antenna structure according to an embodiment of the invention.
Figure 3:
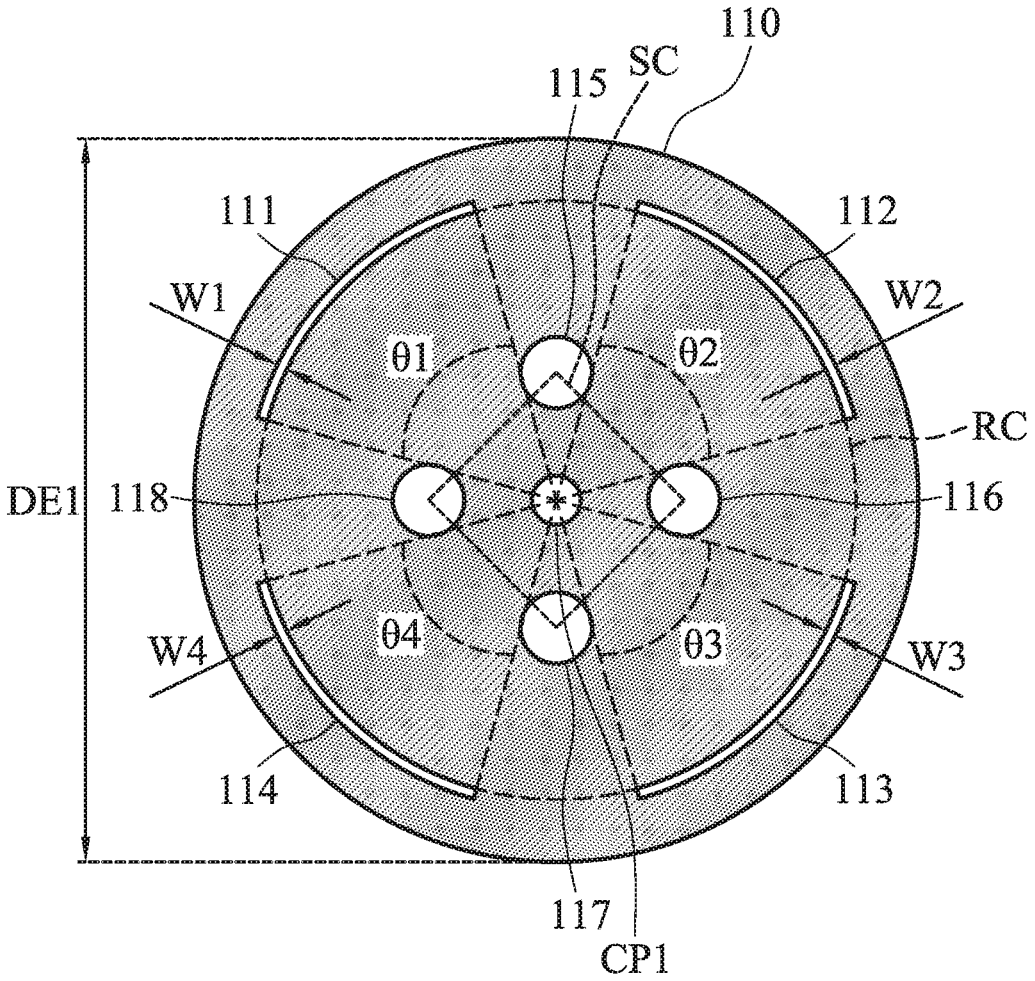
FIG. 3 is a top view of a radiation metal element according to an embodiment of the invention.
Figure 4:
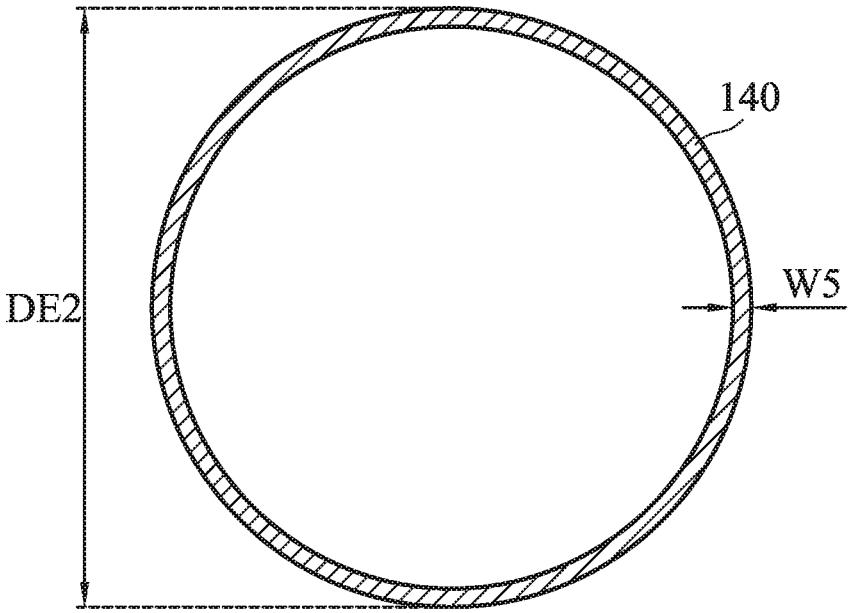
FIG. 4 is a top view of a metal loop according to an embodiment of the invention.

FIG. 1 is an exploded view of an antenna structure 100 according to an embodiment of the invention. FIG. 2 is a top view of the antenna structure 100 according to an embodiment of the invention. As shown in FIG. 1 and FIG. 2, the antenna structure 100 at least includes a radiation metal element 110, a first feeding metal element 120, a second feeding metal element 130, a metal loop 140, a ground metal element 150, a first dielectric layer 161, a second dielectric layer 162, and a via metal element 170. FIG. 3 is a top view of the radiation metal element 110 according to an embodiment of the invention. FIG. 4 is a top view of the metal loop 140 according to an embodiment of the invention. Please refer to FIG. 1, FIG. 2, FIG. 3 and FIG. 4 together to understand the invention.

The via metal element 170 may be a screw column. The via metal element 170 penetrates the first dielectric layer 161 and the second dielectric layer 162, and couples a first connection point CP1 on the radiation metal element 110 to a second connection point CP2 on the ground metal element 150. For example, the first connection point CP1 may be positioned in the center of the radiation metal element 110, and the second connection point CP2 may be positioned in the center of the ground metal element 150, but they are not limited thereto.

The radiation metal element 110 has a first slot 111, a second slot 112, a third slot 113, a fourth slot 114, a first opening 115, a second opening 116, a third opening 117, and a fourth opening 118. The first opening 115, the second opening 116, the third opening 117, and the fourth opening 118 are surrounded by a combination of the first slot 111, the second slot 112, the third slot 113, and the fourth slot 114. In some embodiments, each of the first slot 111, the second slot 112, the third slot 113, and the fourth slot 114 substantially has an arc-shape. The first slot 111, the second slot 112, the third slot 113, and the fourth slot 114 are completely separate from each other. Specifically, the first slot 111, the second slot 112, the third slot 113, and the fourth slot 114 may be all arranged on a specific circumference RC, and the center of the specific circumference RC may be positioned at the first connection point CP1. According to the center of the specific circumference RC, the first slot 111 corresponds to a first central angle θ1, the second slot 112 corresponds to a second central angle θ2, the third slot 113 corresponds to a third central angle θ3, and the fourth slot 114 corresponds to a fourth central angle θ4. The first central angle θ1, the second central angle θ2, the third central angle θ3, and the fourth central angle θ4 may be the same or different. In some embodiments, each of the first opening 115, the second opening 116, the third opening 117, and the fourth opening 118 substantially has a circular shape. The first opening 115, the second opening 116, the third opening 117, and the fourth opening 118 are completely separate from each other. Specifically, the first opening 115, the second opening 116, the third opening 117, and the fourth opening 118 may be respectively positioned at four vertexes of a specific square SC, and the center of the specific square SC may also be positioned at the first connection point CP1. In other words, the first slot 111, the second slot 112, the third slot 113, and the fourth slot 114 may be symmetrically arranged with respect to the first connection point CP1, and the first opening 115, the second opening 116, the third opening 117, and the fourth opening 118 may also be symmetrically arranged with respect to the first connection point CP1.

The aforementioned shapes of the first slot 111, the second slot 112, the third slot 113, the fourth slot 114, the first opening 115, the second opening 116, the third opening 117, and the fourth opening 118 are adjustable according to different requirements, and they may have any geometric shapes. In alternative embodiments, the first slot 111, the second slot 112, the third slot 113, and the fourth slot 114 are all arranged on the periphery of a first geometric pattern, and the first opening 115, the second opening 116, the third opening 117, and the fourth opening 118 are all arranged on the periphery of a second geometric pattern. The first geometric pattern and the second geometric pattern may have a variety of shapes, such as square shapes, rectangular shapes, octagonal shapes, or elliptical shapes, but they are not limited thereto.

The first feeding metal element 120 is coupled to a first feeding point FP1, and extends into the first opening 115 of the radiation metal element 110. Specifically, the first feeding metal element 120 includes a first feeding disc 121 and a first connection element 122. The first feeding disc 121 is coupled through the first connection element 122 to the first feeding point FP1. The first feeding disc 121 and the radiation metal element 110 may be disposed on the same plane. The first feeding disc 121 is disposed in the first opening 115 of the radiation metal element 110. A first coupling gap GC1 is formed between the first feeding disc 121 and the radiation metal element 110. The first connection element 122 may be substantially perpendicular to the first feeding disc 121. The first connection element 122 may penetrate the first dielectric layer 161 and the second dielectric layer 162 and then couple to the first feeding disc 121.

The second feeding metal element 130 is coupled to a second feeding point FP2, and extends into the second opening 116 of the radiation metal element 110. Specifically, the second feeding metal element 130 includes a second feeding disc 131 and a second connection element 132. The second feeding disc 131 is coupled through the second connection element 132 to the second feeding point FP2. The second feeding disc 131 and the radiation metal element 110 may be disposed on the same plane. The second feeding disc 131 is disposed in the second opening 116 of the radiation metal element 110. A second coupling gap GC2 is formed between the second feeding disc 131 and the radiation metal element 110. The second connection element 132 may be substantially perpendicular to the second feeding disc 131. The second connection element 132 may penetrate the first dielectric layer 161 and the second dielectric layer 162 and then couple to the second feeding disc 131.

In some embodiments, the first opening 115 and the second opening 116 of the radiation metal element 110 for accommodating the first feeding disc 121 and the second feeding disc 131 are adjacent to each other, and they are not opposite to each other. Adjustments may be made such that the first feeding disc 121 and the second feeding disc 131 are respectively disposed in any other two adjacent openings, without affecting the performance of the invention. The first feeding point FP1 and the second feeding point FP2 may be coupled to the same signal source or two different signal sources. If a feeding phase difference between the first feeding point FP1 and the second feeding point FP2 is set to about 90 degrees, the antenna structure 100 can provide a circularly-polarized radiation pattern for transmitting or receiving wireless signals in a variety of directions.

The metal loop 140 is floating and not directly coupled to any other metal elements. The radiation metal element 110, the metal loop 140, and the ground metal element 150 may be substantially parallel to each other. The metal loop 140 has a vertical projection on the radiation metal element 110, and the vertical projection of the metal loop 140 may be substantially aligned with the aforementioned specific circumference RC. In other words, the metal loop 140 may be substantially aligned with the first slot 111, the second slot 112, the third slot 113, and the fourth slot 114 of the radiation metal element 110. According to practical measurements, the metal loop 140 is excited by the radiation metal element 110 using a coupling mechanism, so as to increase the operation bandwidth of the antenna structure 100 and enhance the isolation of the antenna structure 100. The ground metal element 150 provides a ground voltage. In alternative embodiments, the shapes of the metal loop 140 and the ground metal element 150 are adjustable according to different requirements, and they may have any geometric shapes.

The first dielectric layer 161 is disposed between the radiation metal element 110 and the metal loop 140. The second dielectric layer 162 is disposed between the metal loop 140 and the ground metal element 150. Specifically, the first dielectric layer 161 has a first surface E1 and a second surface E2 which are opposite to each other, and the second dielectric layer 162 has a third surface E3 and a fourth surface E4 which are opposite to each other. The radiation metal element 110 is disposed on the first surface E1 of the first dielectric layer 161. The metal loop 140 is disposed between the second surface E2 of the first dielectric layer 161 and the third surface E3 of the second dielectric layer 162. The ground metal element 150 is disposed on the fourth surface E4 of the second dielectric layer 162.

In some embodiments, the operation frequency band of the antenna structure covers any one or more of the following frequency intervals: a first frequency interval from 1117 MHz to 1137 MHz, a second frequency interval from 1166 MHz to 1186 MHz, and/or a third frequency interval from 1565 MHz to 1585 MHz. Therefore, the antenna structure 100 can support at least the multiband operations of GPS (Global Positioning System).

In some embodiments, the element sizes and element parameters of the antenna structure 100 are described as follows. The radiation metal element 110 may substantially have a circular shape with a diameter DE1 from 0.36 to 0.69 wavelength of the operation frequency band of the antenna structure 100 (0.36λ~0.69λ). For example, the operation frequency band of the antenna structure 100 may be the lowest frequency one of the first frequency interval, the second frequency interval, and the third frequency interval, but it is not limited thereto. The first central angle θ1 of the first slot 111, the second central angle θ2 of the second slot 112, the third central angle θ3 of the third slot 113, and the fourth central angle θ4 of the fourth slot 114 may all be from 30 to 80 degrees, such as about 57.4 degrees. The (radial) width W1 of the first slot 111, the (radial) width W2 of the second slot 112, the (radial) width W3 of the third slot 113, and the (radial) width W4 of the fourth slot 114 may all be from 0.003 to 0.02 wavelength of the operation frequency band of the antenna structure 100 (0.003λ~0.02λ). The distance DF1 between the center of the first feeding disc 121 and the center of the radiation metal element 110 may be from 0.064 to 0.123 wavelength of the operation frequency band of the antenna structure 100 (0.064λ~0.123λ). The distance DF2 between the center of the second feeding disc 131 and the center of the radiation metal element 110 may be from 0.064 to 0.123 wavelength of the operation frequency band of the antenna structure 100 (0.064λ~0.123λ). The metal loop 140 substantially has a circular shape with a diameter DE2 (the diameter of its outer periphery) from 0.294 to 0.525 wavelength of the operation frequency band of the antenna structure 100 (0.294λ~0.525λ). The width W5 of the metal loop 140 may be from 0.008 to 0.015 wavelength of the operation frequency band of the antenna structure 100 (0.008λ~0.015λ). The diameter of the specific circumference RC may be substantially equal to the diameter DE2 of the metal loop 140. The width of the first coupling gap GC1 may be from 0.006 to 0.012 wavelength of the operation frequency band of the antenna structure 100 (0.006λ~0.012λ). The width of the second coupling gap GC2 may be from 0.006 to 0.012 wavelength of the operation frequency band of the antenna structure 100

(0.006λ~0.012λ). The via metal element 170 may substantially have a cylindrical shape with a diameter DE3 from 0.002 to 0.058 wavelength of the operation frequency band of the antenna structure 100 (0.002λ~0.058λ). The first dielectric layer 161 has a first dielectric constant εr1, the second dielectric layer 162 has a second dielectric constant εr2, and the ratio (εr1/εr2) of the first dielectric constant εr1 to the second dielectric constant εr2 may be from 3 to 10, such as between 4.5 and 6.5. The first dielectric layer 161 has a first thickness H1, the second dielectric layer 162 has a second thickness H2, and the ratio (H1/H2) of the first thickness H1 to the second thickness H2 may be from 3 to 13, such as between 9 and 11. The above ranges of element sizes and element parameters are calculated and obtained according to many experiment results, and they help to optimize the operation bandwidth and impedance matching of the antenna structure 100.

Figure 5:
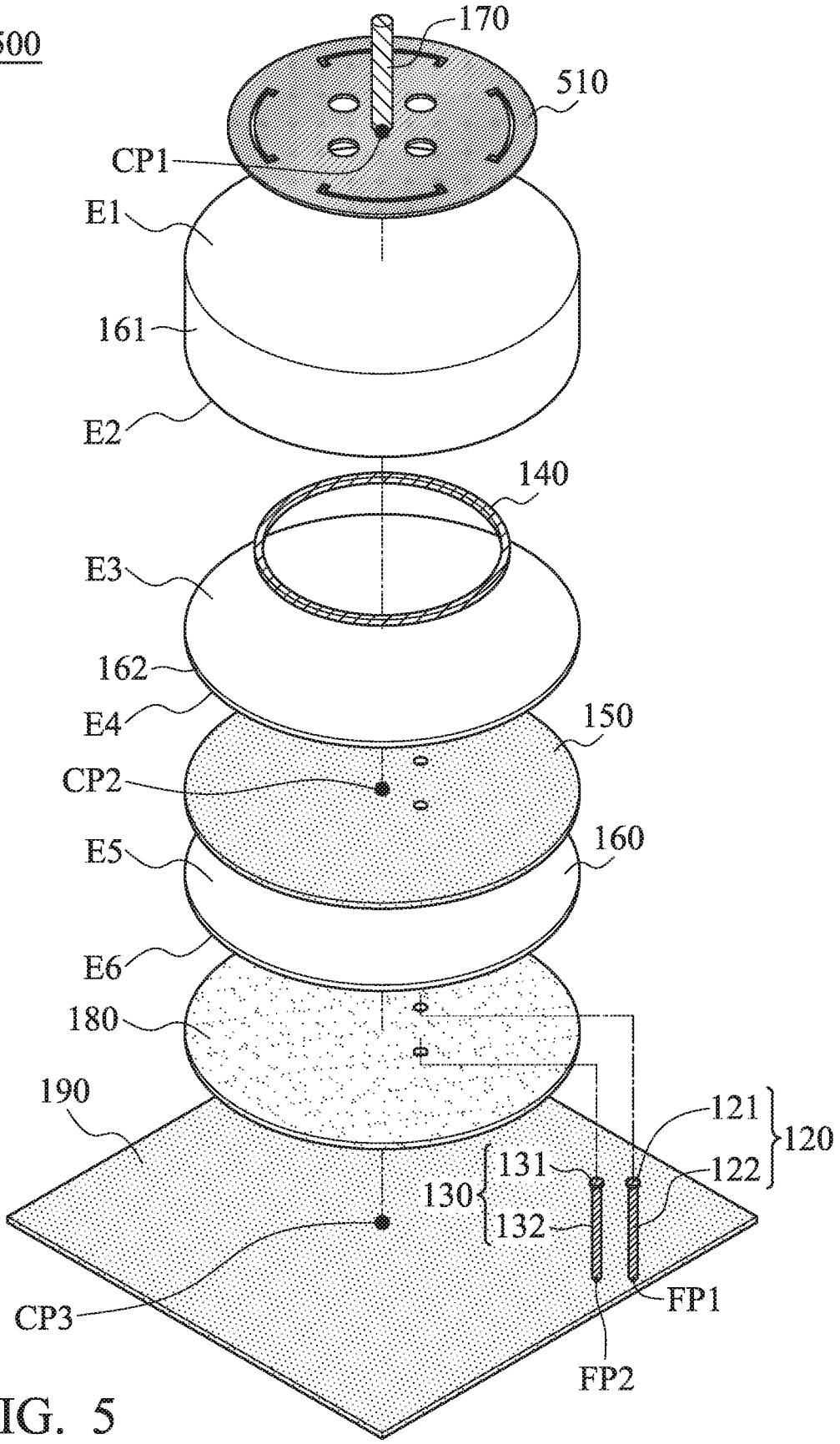
FIG. 5 is an exploded view of an antenna structure according to an embodiment of the invention.
Figure 6:
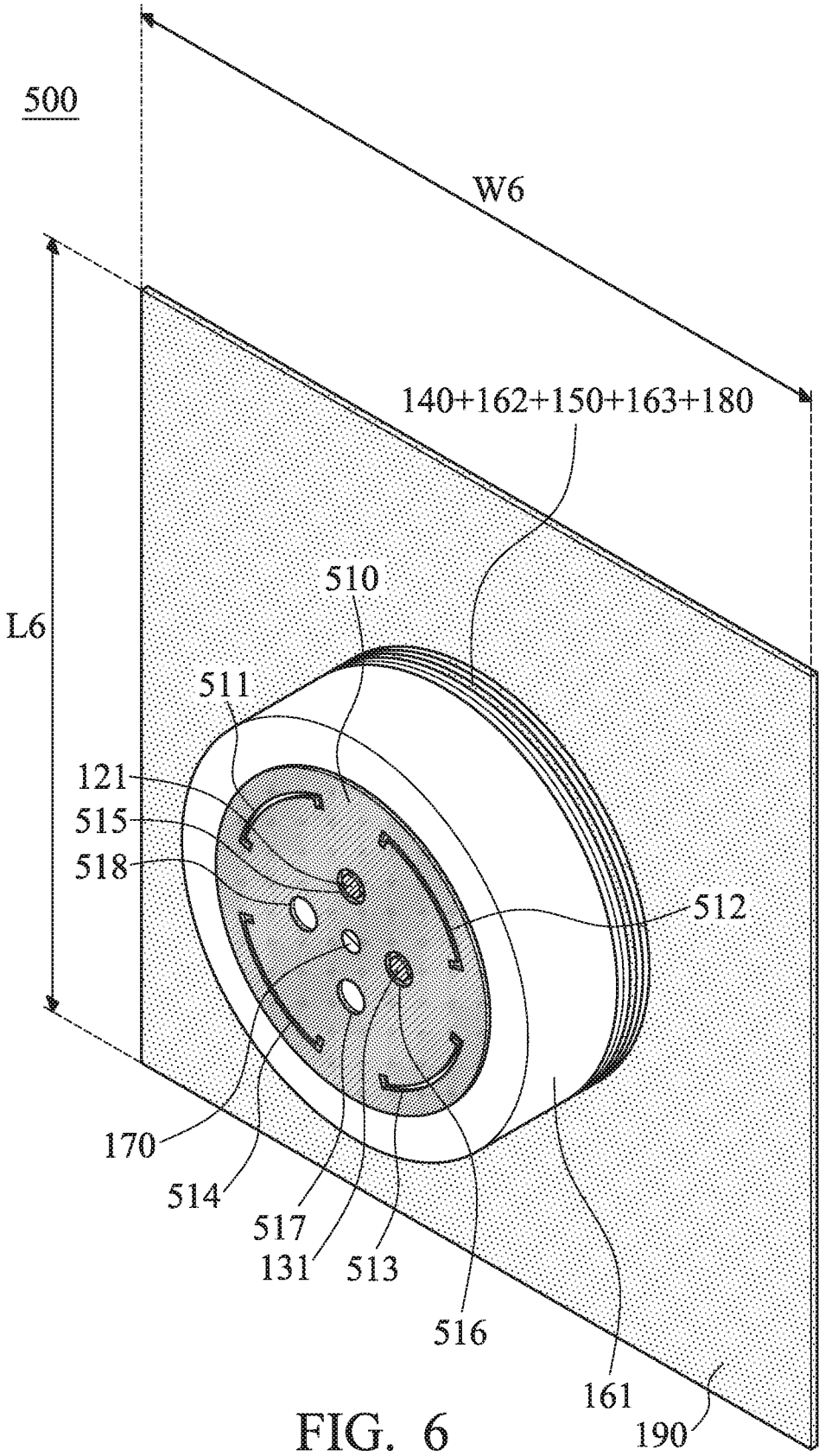
FIG. 6 is a combined view of an antenna structure according to an embodiment of the invention.

FIG. 5 is an exploded view of an antenna structure 500 according to an embodiment of the invention. FIG. 6 is a combined view of the antenna structure 500 according to an embodiment of the invention. FIG. 5 and FIG. 6 are similar to FIG. 1. In the embodiment of FIG. 5 and FIG. 6, the antenna structure 500 includes a radiation metal element 510, a first feeding metal element 120, a second feeding metal element 130, a metal loop 140, a ground metal element 150, a first dielectric layer 161, a second dielectric layer 162, a third dielectric layer 163, a via metal element 170, a circuit layer 180, and a reference ground metal element 190.

The radiation metal element 510 has a first slot 511, a second slot 512, a third slot 513, a fourth slot 514, a first opening 515, a second opening 516, a third opening 517, and a fourth opening 518. The first feeding metal element 120 is coupled to a first feeding point FP1 and extends into the first opening 515. The second feeding metal element 130 is coupled to a second feeding point FP2 and extends into the second opening 516. In the embodiment of FIG. 5 and FIG. 6, each of the first slot 511, the second slot 512, the third slot 513, and the fourth slot 514 includes two terminal bending portions, and thus it substantially has an inverted U-shape. According to practical measurements, using such a design, the user can fine-tune the impedance matching of the antenna structure 500.

The third dielectric layer 163 is disposed between the ground metal element 150 and the circuit layer 180. Specifically, the third dielectric layer 163 has a fifth surface E5 and a sixth surface E6 which are opposite to each other. The ground metal element 150 is disposed on the fifth surface E5 of the third dielectric substrate 163. The circuit layer 180 is disposed on the sixth surface E6 of the third dielectric substrate 163. In some embodiments, the antenna structure 500 further includes a control circuit and its relative traces (not shown), which may be integrated with the circuit layer 180 so as to minimize the whole antenna size. The reference ground metal element 190 is configured to provide a system ground voltage. The reference ground metal element 190 may substantially have a rectangular shape, a square shape, or other geometric patterns. The via metal element 170 further penetrates the ground metal element 150, the third dielectric layer 163, and the circuit layer 180, and couples a second connection element CP2 on the ground metal element 150 to a third connection point CP3 on the reference ground metal element 190, thereby enhancing the grounding stability of the antenna structure 500. For example, the third connection point CP3 may be positioned in the center of the reference ground metal element 190, but it is not limited thereto.

Figure 7:
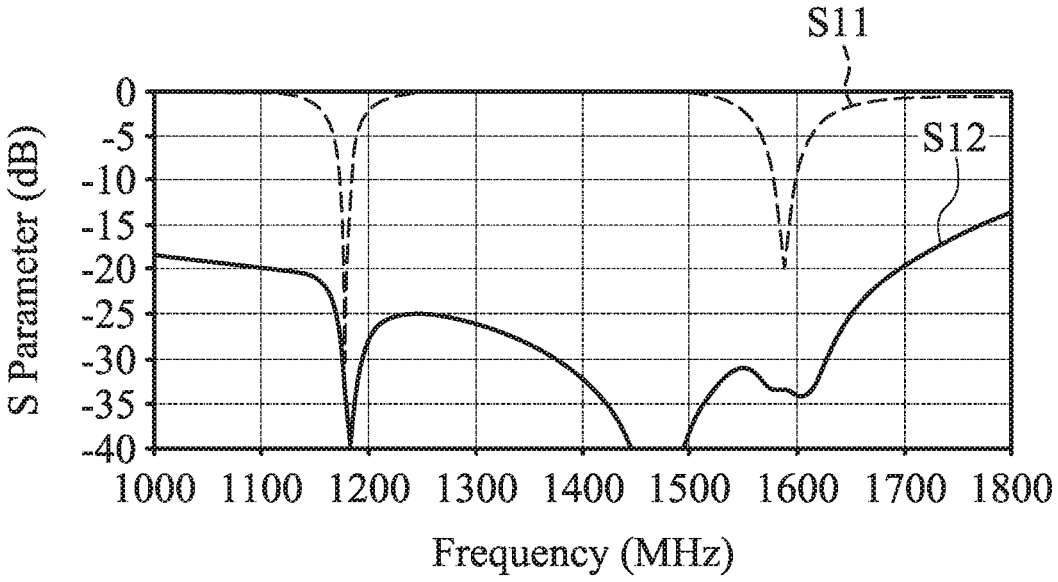
FIG. 7 is a diagram of S-parameters of an antenna structure according to an embodiment of the invention.
Figure 8:
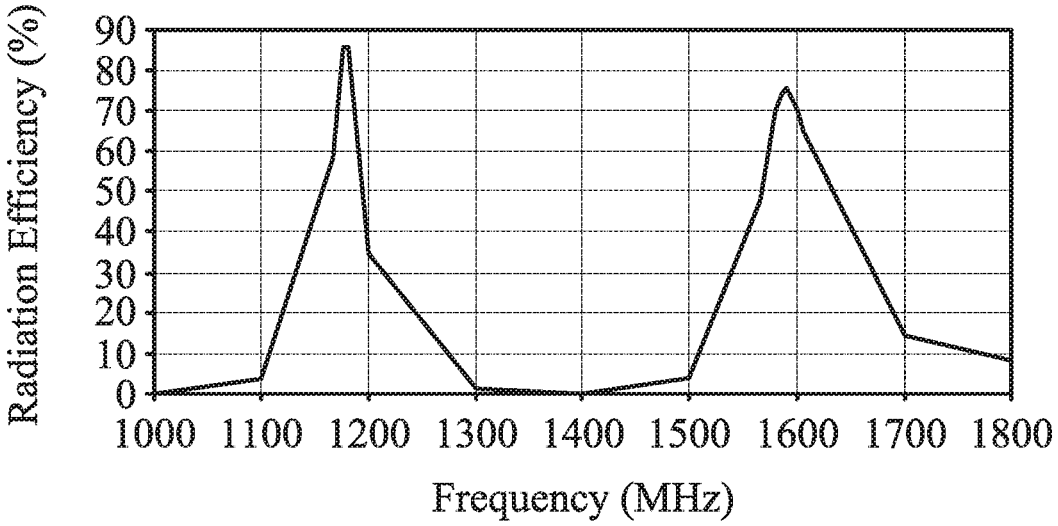
FIG. 8 is a diagram of radiation efficiency of an antenna structure according to an embodiment of the invention.

FIG. 7 is a diagram of S-parameters of the antenna structure 500 according to an embodiment of the invention. The first feeding point FP1 is used as a first port (Port 1) of the antenna structure 500. The second feeding point FP2 is used as a second port (Port 2) of the antenna structure 500. FIG. 8 is a diagram of radiation efficiency of the antenna structure 500 according to an embodiment of the invention. According to the S11 parameter of FIG. 7, the operation frequency band of the antenna structure 500 can cover a second frequency interval from 1166 MHz to 1186 MHz, and a third frequency interval from 1565 MHz to 1585 MHz. Within the aforementioned operation frequency band, the isolation of the antenna structure 500 (i.e., the absolute value of the S21 parameter) may be greater than 30 dB, and the radiation efficiency of the antenna structure 500 may be higher than 70%. It can meet the requirements of practical applications of general communication devices.

In some embodiments, the element sizes and element parameters of the antenna structure 500 are described as follows. The distance between the ground metal element 150 and the reference ground metal element 190 may be from 0.031 to 0.089 wavelength of the operation frequency band of the antenna structure 500 (0.031λ~0.089λ). The length L6 of the reference ground metal element 190 may be longer than 0.5 wavelength of the operation frequency band of the antenna structure 500 (>0.5λ). The width W6 of the reference ground metal element 190 may be longer than 0.5 wavelength of the operation frequency band of the antenna structure 500 (>0.5λ). The above ranges of element sizes and element parameters are calculated and obtained according to many experiment results, and they help to optimize the operation bandwidth and impedance matching of the antenna structure 500. Other features of the antenna structure 500 of FIG. 5 and FIG. 6 are similar to those of the antenna structure 100 of FIG. 1, FIG. 2, FIG. 3, and FIG. 4. Therefore, the two embodiments can achieve similar levels of performance.

The invention proposes a novel antenna structure. In comparison to the conventional design, the invention has at least the advantages of small size, wide bandwidth, circular polarization, and low manufacturing cost. Therefore, the invention is suitable for application in a variety of communication devices.

Note that the above element sizes, element shapes, element parameters, and frequency ranges are not limitations of the invention. An antenna designer can fine-tune these settings or values according to different requirements. It should be understood that the antenna structure of the invention is not limited to the configurations of FIGS. 1-8. The invention may merely include any one or more features of any one or more embodiments of FIGS. 1-8. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a radiation metal element, having a first slot, a second slot, a third slot, a fourth slot, a first opening, a second opening, a third opening, and a fourth opening, wherein the first opening, the second opening, the third opening, and the fourth opening are surrounded by a combination of the first slot, the second slot, the third slot, and the fourth slot;

a first feeding metal element, coupled to a first feeding point, and extending into the first opening;

a second feeding metal element, coupled to a second feeding point, and extending into the second opening;

a metal loop;

a ground metal element;

a first dielectric layer, disposed between the radiation metal element and the metal loop;

a second dielectric layer, disposed between the metal loop and the ground metal element; and a via metal element, coupling a first connection point on the radiation metal element to a second connection point on the ground metal element, wherein the first dielectric layer and the second dielectric layer have different dielectric constants.

2. The antenna structure as claimed in claim 1, wherein the first connection point is positioned in a center of the radiation metal element, and the second connection point is positioned in a center of the ground metal element.

3. The antenna structure as claimed in claim 1, wherein the first slot, the second slot, the third slot, and the fourth slot are completely separate from each other.

4. The antenna structure as claimed in claim 1, wherein each of the first slot, the second slot, the third slot, and the fourth slot substantially has an arc-shape or an inverted U-shape.

5. The antenna structure as claimed in claim 1, wherein the first slot, the second slot, the third slot, and the fourth slot are all arranged on a specific circumference, and a center of the specific circumference is positioned at the first connection point.

6. The antenna structure as claimed in claim 1, wherein the first slot corresponds to a first central angle, the second slot corresponds to a second central angle, the third slot corresponds to a third central angle, the fourth slot corresponds to a fourth central angle, and each of the first central angle, the second central angle, the third central angle, and the fourth central angle is from 30 to 80 degrees.

7. The antenna structure as claimed in claim 1, wherein each of the first opening, the second opening, the third opening, and the fourth opening substantially has a circular shape.

8. The antenna structure as claimed in claim 1, wherein the first opening, the second opening, the third opening, and the fourth opening are respectively positioned at four vertexes of a specific square, and a center of the specific square is positioned at the first connection point.

9. The antenna structure as claimed in claim 5, wherein the metal loop has a vertical projection on the radiation metal element, and the vertical projection of the metal loop is substantially aligned with the specific circumference.

10. The antenna structure as claimed in claim 1, wherein an operation frequency band of the antenna structure covers a first frequency interval from 1117 MHz to 1137 MHz, a second frequency interval from 1166 MHz to 1186 MHz, and/or a third frequency interval from 1565 MHz to 1585 MHz.

11. The antenna structure as claimed in claim 10, wherein the radiation metal element substantially has a circular shape with a diameter from 0.36 to 0.69 wavelength of the operation frequency band.

12. The antenna structure as claimed in claim 10, wherein a radial width of each of the first slot, the second slot, the third slot, and the fourth is from 0.003 to 0.02 wavelength of the operation frequency band.

13. The antenna structure as claimed in claim 10, wherein the metal loop substantially has a circular shape with a diameter from 0.294 to 0.525 wavelength of the operation frequency band.

14. The antenna structure as claimed in claim 10, wherein a width of the metal loop is from 0.008 to 0.015 wavelength of the operation frequency band.

15. The antenna structure as claimed in claim 10, wherein the via metal element substantially has a cylindrical shape with a diameter from 0.002 to 0.058 wavelength of the operation frequency band.

16. The antenna structure as claimed in claim 1, wherein the first dielectric layer has a first dielectric constant, the second dielectric layer has a second dielectric constant, and a ratio of the first dielectric constant to the second dielectric constant is from 3 to 10.

17. The antenna structure as claimed in claim 1, wherein the first dielectric layer has a first thickness, the second dielectric layer has a second thickness, and a ratio of the first thickness to the second thickness is from 3 to 13.

18. The antenna structure as claimed in claim 1, wherein the first feeding metal element comprises:

a first feeding disc, disposed in the first opening of the radiation metal element, wherein a first coupling gap is formed between the first feeding disc and the radiation metal element; and a first connection element, wherein the first feeding disc is coupled through the first connection element to the first feeding point.

19. The antenna structure as claimed in claim 1, wherein the second feeding metal element comprises:

a second feeding disc, disposed in the second opening of the radiation metal element, wherein a second coupling gap is formed between the second feeding disc and the radiation metal element; and a second connection element, wherein the second feeding disc is coupled through the second connection element to the second feeding point.

20. The antenna structure as claimed in claim 1, further comprising:

a circuit layer;

a third dielectric layer, disposed between the ground metal element and the circuit layer; and a reference ground metal element, wherein the via metal element further couples the second connection point on the ground metal element to a third connection point on the reference ground metal element.

* * * * *